US006145707A

United States Patent [19]

Baudin

[11] Patent Number: 6,145,707

[45] Date of Patent: Nov. 14, 2000

[54] DISPENSING HEAD AND A DISPENSER INCLUDING THE SAME

[75] Inventor: Gilles Baudin, Domont, France

[73] Assignee: L'Oréal S.A., Paris, France

[21] Appl. No.: 09/170,007

[22] Filed: Oct. 13, 1998

[30] Foreign Application Priority Data

Oct. 10, 1997 [FR] France ..... 97 12698

[51] Int. Cl.[7] ..... B67D 5/58

[52] U.S. Cl. ..... 222/189.09; 222/494

[58] Field of Search ..... 222/490, 491, 222/494, 213, 212, 189.09

[56] References Cited

U.S. PATENT DOCUMENTS

| | | | |
|---|---|---|---|
| 1,987,156 | 1/1935 | Paparello | 222/494 |
| 4,533,068 | 8/1985 | Meierhoefer | 222/189.09 |
| 5,074,440 | 12/1991 | Clements et al. | 222/189.09 |
| 5,447,258 | 9/1995 | Suzuki | 222/494 |
| 5,927,559 | 7/1999 | Bommer et al. | 222/189.09 |

FOREIGN PATENT DOCUMENTS

| | | |
|---|---|---|
| 0 485 342 | 5/1992 | European Pat. Off. . |
| 0 500 249 | 8/1992 | European Pat. Off. . |
| 0 554 181 | 8/1993 | European Pat. Off. . |
| 0 673 852 | 9/1995 | European Pat. Off. . |
| 0 851 429 | 1/1940 | France . |
| 2 588 835 | 4/1987 | France . |
| 43-006473 | 3/1943 | Japan . |
| 4-006052 | 1/1992 | Japan . |
| 5-054306 | 7/1993 | Japan . |
| 9-040000 | 2/1997 | Japan . |
| WO 92/12065 | 7/1992 | WIPO . |
| WO 93/10015 | 5/1993 | WIPO . |

OTHER PUBLICATIONS

English Language Derwent Abstract of EP 0 554 181.
English Language Derwent Abstract of EP 0 673 852.
English Language Derwent Abstract of FR 2 588 835.

*Primary Examiner*—Kevin Shaver
*Assistant Examiner*—Thach Bui
*Attorney, Agent, or Firm*—Finnegan, Henderson, Farabow, Garrett & Dunner, L.L.P.

[57] ABSTRACT

A dispensing head for a container is disclosed. The dispensing head includes a portion defining at least one opening on the dispensing head for permitting dispensing of a product via the opening. A valve is configured to limit direct flow of air into the container via the opening and to permit dispensing of the product via the opening. The dispensing head further includes porous material impervious to the product and capable of allowing passage of air into the container via the porous material. The porous material is at least partially exposed on an exterior surface of the dispensing head. In addition, part of the valve is formed of the porous material and the porous material at least partially defines the opening on the dispensing head. Also disclosed is a dispenser including the dispensing head and a container containing the product. The dispensing head is provided on the container.

68 Claims, 3 Drawing Sheets

DISPENSING HEAD AND A DISPENSER INCLUDING THE SAME

The present invention relates to a dispensing head and a dispenser including the dispensing head. In particular, the present invention relates to dispensing of products requiring protection from microbes or bacteria and dispensing of products from dispensers having an air intake. The invention has particular advantages when used to dispense cosmetic or pharmaceutical products having a viscous consistency in the form of paste, gel, cream, or milk.

There are a number of different dispensing devices including an air-intake orifice isolated from the contents of a container by a filter which may be soaked in an anti-microbial composition. For example, EP-A-0,500,249 discloses a dispensing device having an air intake circuit distinct from a dispensing circuit for dispensing a sterile composition. Although this device appears to maintain some sterility of the composition, it is relatively complicated and expensive to manufacture because it includes these two separate flow circuits. The configuration of this device also may permit a product to reside between a filter and a product-outlet orifice in contact with unfiltered air. In addition, the filter of this device is recessed in one or more intake orifices capable of collecting dirt, dust, or other particulate material.

Dispensing devices are also described in EP-A-0,485,342, WO 92/12065, and WO 93/10015. These dispensing devices have drawbacks and disadvantages similar or identical to those of the dispensing device described in above-mentioned EP-A-0,500,249.

FR-A-2,588,835 discloses a device wherein a product is dispensed through pores or orifices of a membrane attached to the neck of a bottle. As the product flows though the pores, it fills the pores and prevents air from passing through the pores after the product is dispensed. With this device, it is also difficult to dispense very viscous compositions. During dispensing, the pores expand to permit the product to flow through them and then contract. After a prolonged period, this expansion and contraction of the pores could enlarge the cross-section of the pores in their relaxed state.

In light of the foregoing, there is a need in the art for an improved dispenser and an improved dispensing head for a container.

Accordingly, the present invention is preferably directed to a dispensing head and a dispenser that substantially obviate one or more of the limitations of the related art. In particular, the present invention preferably maintains a product in a relatively sterile condition.

One of the preferred objects of the invention is to provide a device in which product dispensing and air intake are provided through essentially the same flow circuit, while at the same time protecting the product sufficiently against microbes or bacteria in the surrounding air.

It should be understood that the invention could still be practiced without performing one or more of the preferred objects and/or advantages. Still other objects and/or advantages will become apparent after reading the following description of the invention.

To achieve these and other advantages and in accordance with the purpose of the invention, as embodied and broadly described herein, the invention includes a dispensing head for a container containing a product. The dispensing head includes a portion defining at least one opening on the dispensing head for permitting dispensing of the product via the opening. A valve is configured to limit direct flow of air into the container via the opening and to permit dispensing of the product via the opening. The dispensing head further includes porous material impervious to the product and capable of allowing passage of air into the container via the porous material.

In one aspect of the invention, the porous material is at least partially exposed on an exterior surface of the dispensing head.

In another aspect of the invention, the porous material at least partially defines the opening on the dispensing head.

In yet another aspect, the valve includes a seat and at least one member movable between a first position in which the at least one member contacts the seat to limit direct flow of air into the container via the opening (i.e., limit air flowing directly into the opening without first passing through additional structure) and a second position in which the at least one member is spaced from the seat to permit dispensing of the product via the opening.

In a further aspect, the seat and/or the member are formed of the porous material.

In a preferred embodiment, the member selectively closes the opening(s) of the dispenser. Preferably, the member is elastic and capable of moving away from the opening (s) under the pressure of the product in order to uncover the opening(s) and to allow the product to pass so that it can be dispensed. When the dispensing pressure terminates, the member is also preferably capable of elastically returning into contact with a seat formed on the dispensing head.

In the preferred embodiment, the porous material allows filtered air to be taken into the container via the porous material. The opening(s) of the dispenser is (are) preferably separate from the pores or cells of the porous material. Preferably, the porous material is at least partially accessible directly on the outside of the dispensing head. In other words, at least a portion of the porous material preferably communicates directly with the outside air. This structural arrangement is different from that of devices having a filtration element that is positioned inside of a dispensing head and that communicates with the outside air via one or more orifices, generally having a small size.

Preferably, the product flows through the outlet formed between the seat and a free end or a free edge of the valve member. Therefore, the product does not flow through the pores of the porous material and thereby limit the effectiveness of the porous material functioning as an air intake. In other words, the product flows from the container through the outlet formed between the seat and the valve member, and the intake air flows into the container along a different path, via the porous material. These two flows may be provided in an effective way. In contrast to the structure disclosed in above-mentioned FR-2,588,835, where the size of the pores increases under the pressure of the product to permit the product to pass, the size of the pores on the porous material of the present invention preferably does not increase during dispensing. In fact, when the porous material is a block of open-cell foam, the open cells may even compress under the pressure of the product, depending on the position of the block of foam with respect to the flow of product.

The dispensing head is preferably simple to produce because it preferably lacks an air intake circuit which is separate from the product-dispensing circuit and which includes auxiliary passages or orifices capable of becoming soiled. Preferably, the product is substantially or completely isolated from the surrounding air and from the microbes or bacteria in the surrounding air. In addition, the design of the dispensing head with air intake of the present invention may have the same shape as that of a dispensing head without an air intake. Because of this arrangement, a conventional dispenser without an air intake could be modified to include the porous material of the present invention. The increase in cost associated with this modification may be negligible.

As mentioned above, at least a part of the porous material is directly accessible from outside the container. This allows the material to be cleaned relatively easily, by simply running hot water over it. In contrast, cleaning of filtration parts in conventional devices is more difficult because these filtering parts are often recessed and provided at the end of passages formed in the wall of a dispenser.

Preferably, the surface for providing air filtration and intake is much larger than that of some conventional configurations where air is taken in through one or more orifices or passages. For example, the area permitting air flow from the outside may range from a few $mm^2$ to a few $cm^2$.

In the preferred embodiment, the porous material preferably includes an anti-microbial substance to increase the protection of the product contained in the container. For example, the microbial substance is embedded in the porous material by soaking the porous materia in the substance.

Preferably, the porous material has a porosity appropriate for the viscosity and nature of the product being dispensed. For example, the porous material has a porosity of preferably from about 1 $\mu$m to about 500 $\mu$m, more preferably from 1 $\mu$m to 500 $\mu$m, even more preferably from about 10 $\mu$m to about 200 $\mu$m, and still more preferably from 10 $\mu$m to 200 $\mu$m. As used herein, the term "porosity" refers to the average maximum dimension for the pores of the porous material. For example, when the pores are generally spherical, the porosity refers to the average diameter of the pores.

In a preferred embodiment, all or a portion of the valve member and/or the seat is formed of the porous material to allow air to be taken in somewhat close to the product-outlet opening(s). With this configuration, a portion of the air inlet flow circuit and a portion of the product dispensing circuit may be identical, and the product dispensing outlet(s) and air intake opening(s) may be different. Locating the product dispensing outlet(s) and the air intake opening(s) close to one another maintains relative sterility of all of the product in the container including the residual product in the product-outlet circuit upstream of the valve member. This also allows better, particularly faster, closure of the valve member.

Preferably, the present invention includes a removable cap or a lid for covering the dispensing opening and/or the porous material during storage. The cap or lid may have a smaller size than the caps or lids of conventional devices, because only the region surrounding the outlet orifice needs to be covered.

According to one embodiment of the invention, the opening on the dispensing head and the valve member have an annular shape and encircle the seat. In this embodiment, the member has a free end contacting the seat when the member is in its closed position. The seat may be held in position in the opening by means of tabs arranged radially around the central seat. These tabs preferably have one end connected to the seat and another end connected to a mounting element placed in the opening.

According to another embodiment, the seat has an annular shape and defines the opening. In addition, the member is configured to move from the first (closed) position to the second (open) position in response to pressure of the product.

In yet another embodiment, the dispensing head is configured in the form of a push button capable of being mounted on a hollow stem of a manually operated pump to permit actuation of the pump. This makes it possible to use a pump that does not have its own air intake, thus making it possible to produce a pump at a cost that is substantially lower than that of conventional pumps.

According to a further embodiment, the dispensing head forms a dispensing adaptor capable of allowing localized application of the product. The adaptor includes a first part made of the porous material and a second part made of a non-porous material. The first part forms the seat (or the valve member), and the second part forms the valve member (or the seat). Preferably, the adaptor has a moulded body formed of the non-porous material and including the second part. The body is capable of being mounted on a container and is preferably made of low-density polyethylene. The adaptor of this embodiment is particularly suitable for dispensing a hair product, when this dispensing has to be localized, particularly near the roots of the hair.

In some of the embodiments, the member of the valve is formed of an elastically-deformable porous material. This one piece structure limits direct flow of air into the dispensing opening (i.e., limits air flowing directly into the opening without first passing through additional structure) and permits air flow through the member.

Preferably, the elastically-deformable porous material is a semi-crystalline thermoplastic frit, especially a frit of ethylene-vinyl acetate copolymer, very-low-density polyethylene, or an open-cell polyurethane foam, etc. Other materials may also be used.

The seat is preferably formed of a rigid or semi-rigid material, such as polyolefins, especially polypropylenes, high-density or low-density polyethylenes, or polyvinyl chlorides, etc.

In an alternative embodiment, the seat is formed of a porous material such as polyolefin, especially high-density or low-density polyethylene frits, polypropylene frits, polyethylene and polypropylene frits, semi-crystalline thermoplastic frits, especially frits of ethylene-vinyl acetate copolymer, very-low-density polyethylene, or polyurethane foams, etc.

When the valve member is made of a non-porous elastically deformable material, this material is preferably chosen from natural, synthetic or thermoplastic elastomers, especially copolymers of polypropylene and of SEBS, styrene-butadiene or ethylene-vinyl acetate copolymers, very-low-density polyethylenes, nitrile rubbers, polychloroprene or neoprene, ethylene-propylene-diene monomer terpolymers (EPDM), butadiene-acrylonitrile copolymers, polyurethanes, plasticized polyvinyl chlorides, and cross-linked rubbers, especially those based on silicone, etc.

In an even further aspect of the invention, a dispenser is provided. The dispenser includes a container containing the product, and the dispensing head on the container.

The container may be a container having at least one deformable wall, and the product may be pressurized by exerting pressure on the deformable wall(s). For example, the container is a flexible walled bottle or tube.

The product in the container preferably has a viscous consistency, and is preferably a cosmetic or pharmaceutical product. For example, the product is chosen from a cream, a gel, a milk, and a paste, etc.

In the preferred embodiment, the dispensing head is removably mounted on the container. Preferably, the dispensing head includes a first coupling element and the container includes a second coupling element. The first and second coupling elements are configured to removably couple together to removably couple the dispensing head on the container.

In an alternative embodiment, the dispensing head is permanently mounted on the container. For example, the dispensing head and the container could be a unitary, one piece structure.

Besides the structural arrangements set forth above, the invention could include a number of other arrangements, such as those explained hereinafter. It is to be understood that both the foregoing general description and the following detailed description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1 is a cross-sectional view of a portion of dispenser including a dispensing head according to a first embodiment of the invention;

Figure 1:
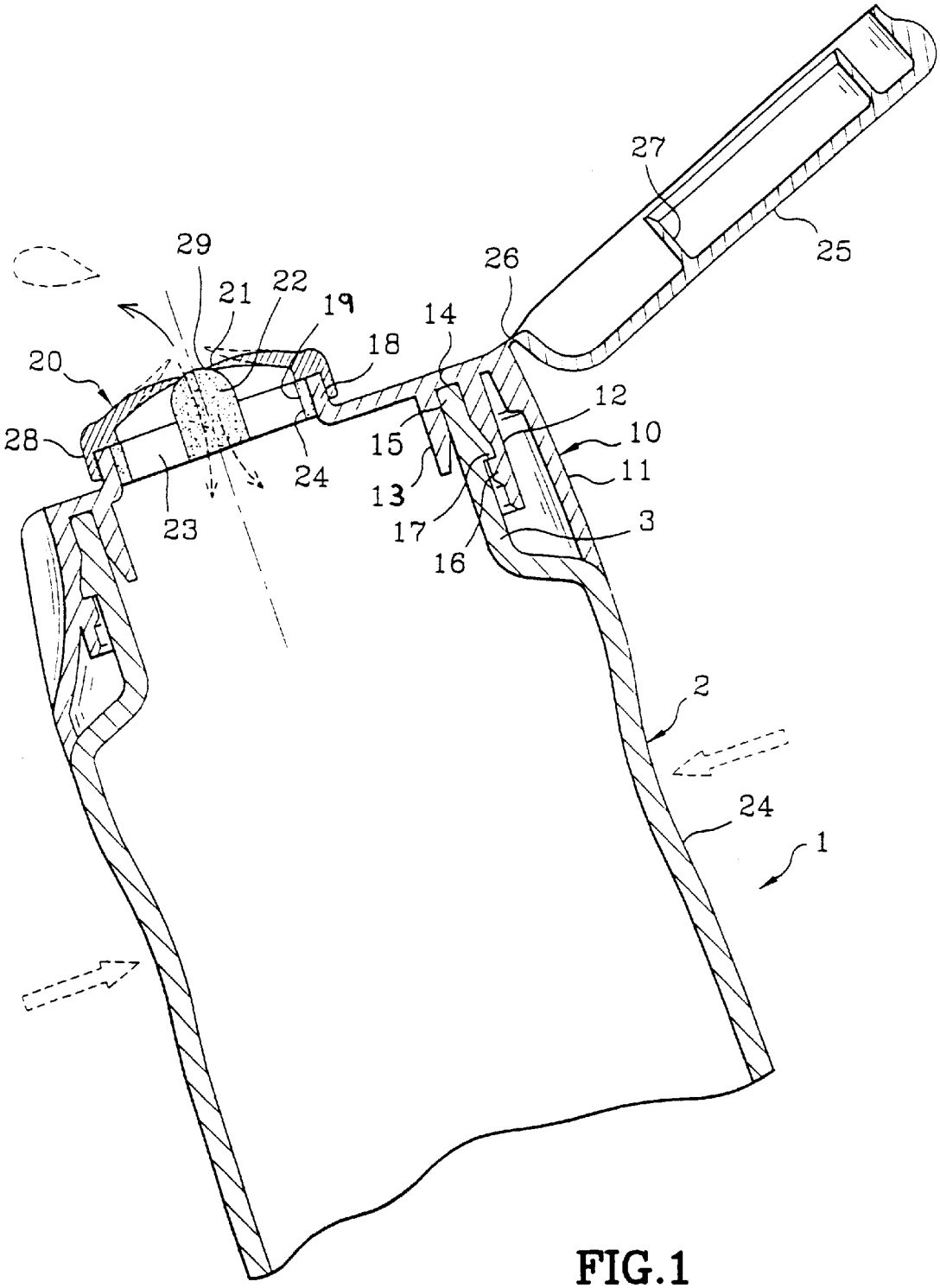

Reference will now be made in detail to the present preferred embodiments of the invention, examples of which are illustrated in the accompanying drawings. Wherever possible, the same reference numbers are used in the drawings and the description to refer to the same or like parts having similar structural configuration(s) and/or function(s).

FIG. 1 shows a dispenser including a container 1 and a dispensing head 10 on the container 1. Preferably, the container 1 contains a product capable of being dispensed via the dispensing head 10. The container 1 is preferably a flexible-walled bottle, particularly made of a mixture of polyethylene and polypropylene. The container 1 includes a body 2 having a closed bottom and a neck 3.

The neck 3 of the container 1 preferably includes a first coupling element 17 capable of being removably coupled to a corresponding second coupling element 16 on the dispensing head 10 to permit removable coupling of the dispensing head 10 on the container 1. In the embodiment shown in FIG. 1, the first coupling element 17 is a bead on the outer surface of the neck 3 and the second coupling element 16 is a snap-fitting rib on an inner skirt 12. The bead 17 and the rib 16 permit removable snap fastening of the dispensing head 10 on the container 1.

The dispensing head 10 includes an outer skirt 11 forming a covering. The dispensing head also has an inner skirt 13 in addition to the inner skirt 12. The inner skirts 12 and 13 define between them an annular groove 14 for accommodating a free edge 15 of the neck 3. The interaction of the skirts 12 and 13 together with the neck 3 permits mounting of the dispensing head 10 on the container 1 in a leak-tight manner.

The dispensing head 10 preferably includes a portion defining at least one dispensing opening 19 on the dispensing head 10 for permitting dispensing of the product via the opening 19. The dispensing head 10 also preferably includes a valve configured to limit direct flow of air into the container via the opening 19 (i.e., limit air flowing directly into the opening without first passing through additional structure) and to permit dispensing of the product via the opening 19. As shown in FIG. 1, the valve preferably includes at least one valve member 20 and a seat 22. The member 20 is movable between a first position in which the member 20 contacts the seat 22 to limit direct flow of air into the container 1 and a second position in which the member 20 is spaced from the seat 22 to permit dispensing of the product via the opening 19. When the valve member 20 is in the first position, the member 20 preferably covers the opening 19 and limits flow of product from the dispensing head 10.

The dispensing head 10 also preferably includes porous material impervious to the product and capable of allowing passage of air into the container 1 via the porous material. This material is preferably at least partially exposed on an exterior surface of the dispensing head 10, Preferably, the porous material also at least partially defines the opening 19. In addition, the member 20 and/or the seat 22 are preferably formed of the porous material. As shown in FIG. 1, an annular portion 24 surrounding and defining the opening 19 is formed of the porous material. In addition, the seat 22 shown in FIG. 1 is formed of the porous material.

In the embodiment of FIG. 1, the container 1 includes a lip 18. The valve member preferably is force fit (or mounted by any other way) on the lip 18. An inner free end or edge 21 of the member 20 and the seat 22 define a selectively openable outlet 29. In the relaxed position, the inner edge 21 rests on the seat 22. The opening 19 and the member 20 have annular shape and encircle the seat 22.

The seat 22 forms a dome located essentially on the neck 3 of the container 1. The top portion of the seat 22 communicates directly with the outside of the dispensing head 10. The seat 22 is supported by radial tabs 23 (for example, three of tabs 23). The tabs 23 have a first end secured to the seat 22 and a second end secured to the annular portion 24, which is force fit in the lip 18.

According to a particular embodiment, the seat 22 is formed of a rigid or semi-rigid porous material, particularly a polypropylene, high-density polyethylene or low-density polyethylene frit. Alternatively, the seat 22 is formed of a more flexible material, such as an ethylene-vinyl acetate copolymer frit. In practice, the seat 22 shown in FIG. 1 could be formed of any material impervious to the product contained in the container and capable of allowing air to pass.

The valve member 20 shown in FIG. 1 is preferably formed of a flexible, elastically-deformable material, such as an ethylene-propylene-diene copolymer (EPDM).

To dispense a dose of product, a user exerts pressure on the walls 24 of the container 1, for example in the direction of the broken arrows shown in FIG. 1. Under the pressure of the product, the free edge 21 of the valve member 20 moves away from the seat 22 (to the position shown with broken lines) to allow the product to pass through the outlet 29 (as shown by the solid arrows in FIG. 1) located between the seat 22 and the free edge (end) 21 of the member 20 when the member is in its distorted position. The user can take up the product on her finger, for example. When the pressure of the product ceases, for example, when pressure exerted on the walls 24 is released, the free edge 21 elastically returns into position on the seat 22 to cover the opening 19 and to limit direct flow of air into the container 1 via the opening 19. At this instant, under the effect of the partial vacuum inside the container 1, air is drawn into the container via the pores of the porous material forming the seat 22, and continues to do so until pressure in the container 1 becomes balanced. Clean closure of the opening 19 is thus achieved, and the air-intake takes place in the region of the product outlet.

When air flows through the porous material, such as the porous material forming the seat 22, the air is filtered. This protects the product and keeps it under relatively sterile conditions. Preferably, the porous material includes an anti-microbial substance to protect the product still further.

A lid 25 is provided for removably covering the opening 19. The lid 25 is hinged about an axis 26, and has a sealing skirt 27 capable of coming into sealed contact around an outer lateral edge 28 of the valve member 20.

Figure 2:
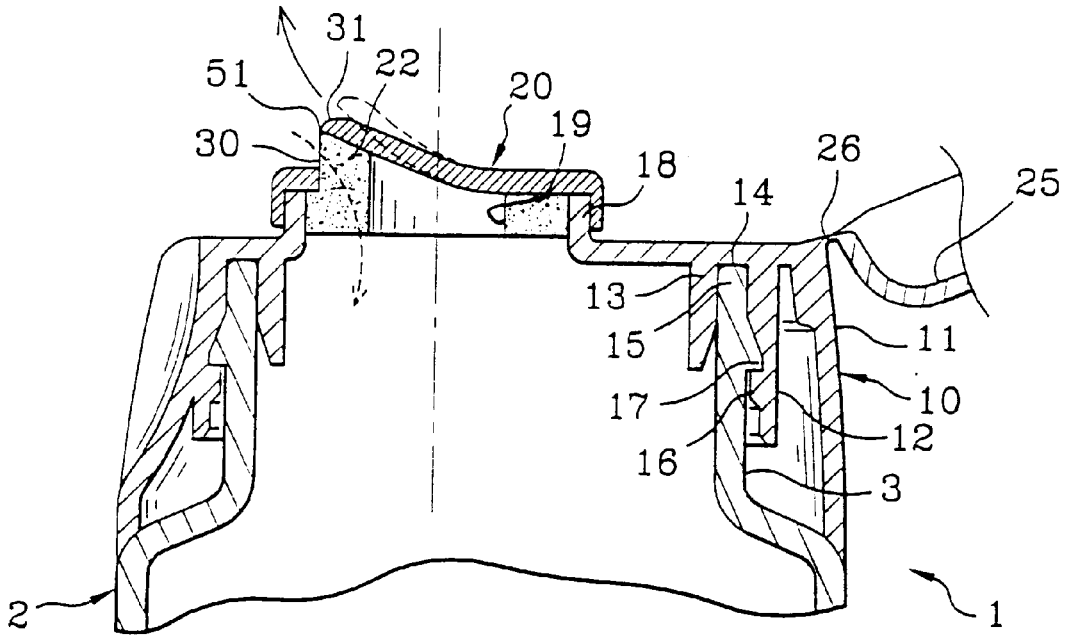
FIG. 2 is a view similar to that of FIG. 1 showing a second embodiment of the dispensing head.

In the embodiment of FIG. 2, a seat 22 is formed of the porous material. The seat 22 has an annular shape and defines the opening 19. A portion 30 of the seat is raised up above the top of the lip 18 so that the raised portion 30 is in direct communication with the outside. The portion 30 has a top surface slightly inclined towards the opening 19.

The seat 22 is force fit into the lip 18. The member 20 is mounted by bonding, welding, snap-fastening or any other means, onto the lip 18, and has a free end 31 for contacting the raised portion 30 of the seat 22. In the relaxed position of the member 20, the free end 31 closes off an outlet orifice 51 and covers the opening 19. Under pressure of the product, the free end 31 moves (flexes) away from the raised portion 30 (to the position shown in broken lines) to allow the product to pass through the orifice 51 (as shown by the continuous arrow). When the pressure ceases, the free end 31 elastically returns to the closing-off (covering) position on the seat 22 so that direct flow of air through the opening 19 is limited. Under the effect of the partial vacuum created inside the container 1, air is drawn into the container 1 via the raised portion 30 of the porous seat 22 (as shown by the broken arrow of FIG. 2).

Figure 3:
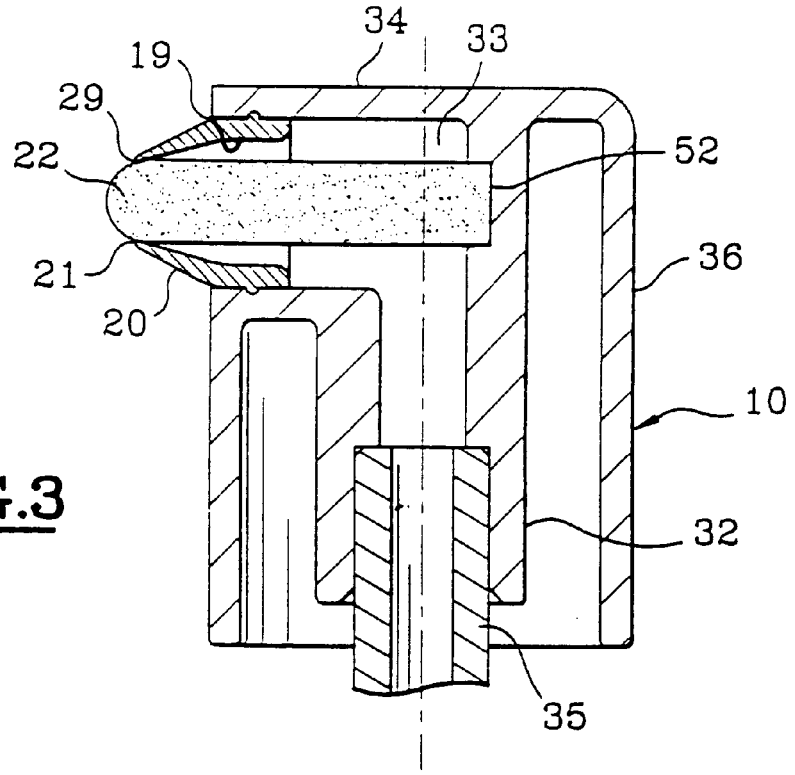
FIG. 3 is a view similar to that of FIG. 1 showing a third embodiment of the dispensing head.

In the embodiment of FIG. 3, the dispensing head 10 is configured as a push-button 36 capable of being mounted on a container equipped with a manually actuated pump. The dispensing head 10 includes an axial skirt 32 having an inside diameter suitable for force-fitting on a pump stem 35. The axial skirt 32 opens into a passage 33, approximately perpendicular to the axial skirt 32. The passage 33 opens into an annular opening 19 defined between a seat 22 formed of porous material and an annular valve member 20 formed of elastically deformable material. The seat 22 has a dome shape, and one end of the seat 22 communicates directly with the outside of the dispensing head 10. The seat 22 is force-fit into a recess 52 in the side wall of the axial skirt 32.

The opening 19 is closed off by the valve member 20, which is preferably snap-fastened on the dispensing head 10. Similar to the embodiment of FIG. 1, the valve member 20 shown in FIG. 3 has an inner edge 21 resting on the seat 22 and defining a closable outlet 29.

In the embodiment of FIG. 3, the porous seat 22 is preferably formed of a very low density polyethylene frit, and the valve member 20 is preferably formed of plasticized PVC. The operation of the embodiment shown in FIG. 3 is identical to that of the embodiment of FIG. 1, aside from the fact that the pressurized product is expelled by a manually-operated pump, actuation of which is controlled by exerting pressure on a bearing surface 34 formed by the push-button 36.

Figure 4:
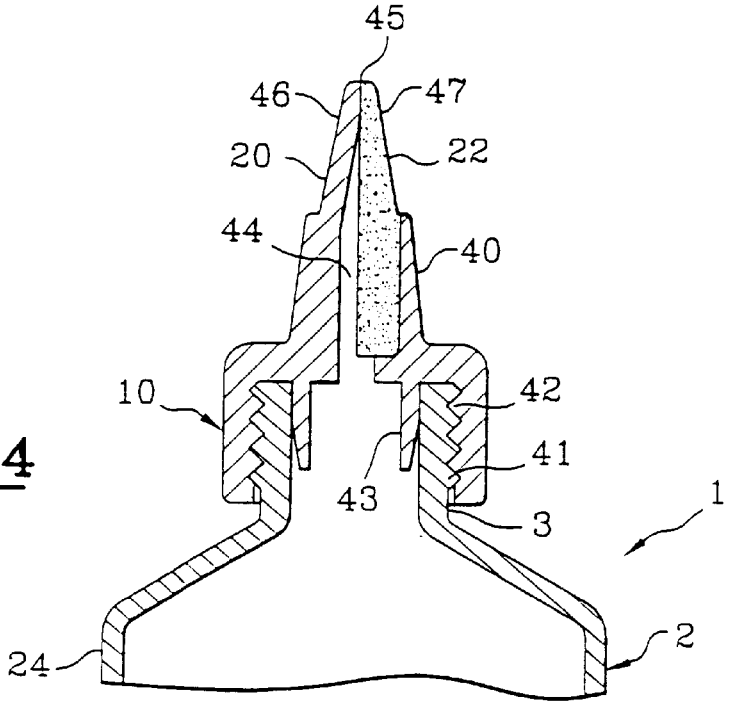
FIG. 4 is a view similar to that of FIG. 1 showing a fourth embodiment of the dispensing head.

In the embodiment of FIG. 4, the dispensing head 10 is in the form of an adaptor 40 permitting localized application of the product to be dispensed. The adaptor 40 is capable of being removably coupled on the container 1. An internal surface of the adaptor 40 includes screw threads 42 capable of being removably coupled to screw threads 41 on a neck of the container 1. An inner skirt 43 improves the leak-tightness of the assembly.

The adaptor 40 defines an axial passage (opening) 44 ending at an outlet 45 defined between an edge portion 46 and an element 47. The edge portion 46 forms an integral part of the dispensing adaptor 40 and extends over approximately 180° (with respect to an axis of the adaptor 40 in a plane perpendicular to the plane of the cross-sectional view of FIG. 4). The adaptor 40 is preferably formed of flexible material, such as low-density polyethylene, so that the edge portion 46 forms an elastically-deformable valve member 20.

The element 47 is preferably formed of the porous material. For example the element is formed of polypropylene frit. The element 47 provides a seat 22 for the valve member 20. The element 47 extends over 180° (with respect to an axis of the adaptor 40 in a plane perpendicular to the plane of the cross-sectional view of FIG. 4) and may be welded or bonded onto the adaptor 40. The element 47 has an outer surface in direct contact with the surrounding air. In addition, the element 47 plays a part in defining the product-outlet circuit, namely the axial passage 44. This reduces the size of a cap or lid for protecting the dispenser during storage and only the adaptor 40 need be covered.

By exerting pressure on the walls 24 of the container 1 shown in FIG. 4, the product is driven towards the outlet 45, and causes the elastically deformable member 20 to move (flex) away from the seat 22 to allow the product to pass through the orifice 45. The product may be applied directly in a localized way to a surface to be treated. When the pressure ceases, the elastically-deformable part 20 comes back to rest on the seat 22, and air is drawn in through the porous material forming the seat 22. The air continues to be drawn in via the seat 22 until pressures are balanced.

According to an alternative version of the embodiment of FIG. 4, the portion 46 is a moulded part of the dispensing adaptor 40 and is formed of a rigid material, such as polypropylene. In this alternative version, the element 47 is formed of an elastically deformable porous material so the element 47 acts as the valve member and the portion 46 acts as the seat. Because the element 47 is porous, it permits air to be taken in to the container 1. For example, the element 47 is formed of an ethylene-vinyl acetate copolymer frit.

Figure 5:
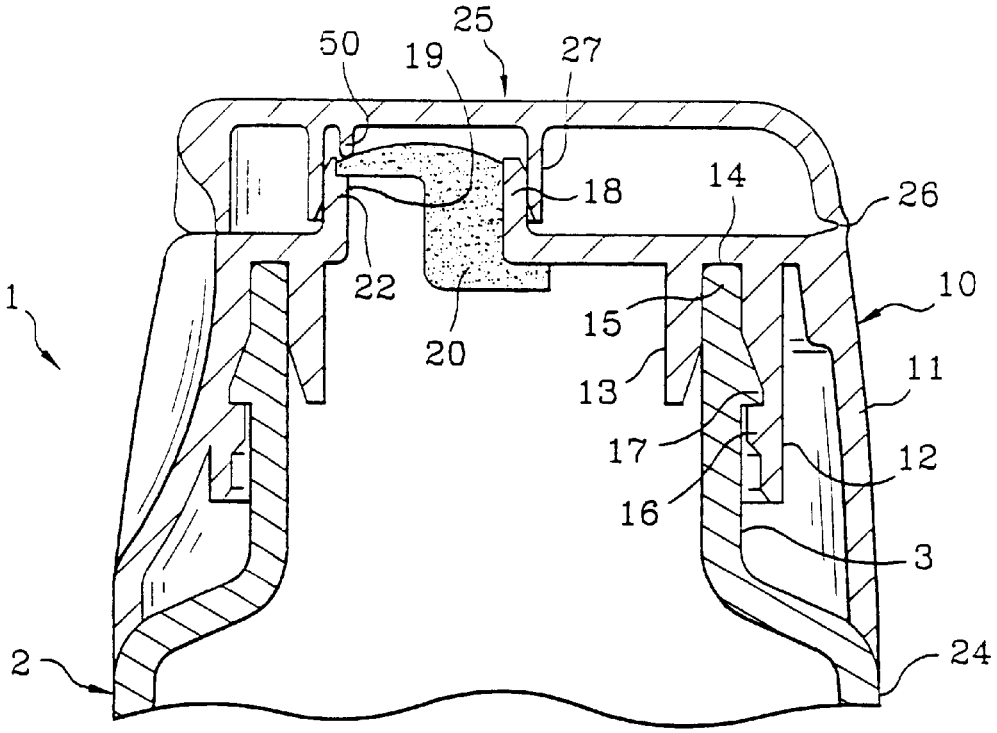
FIG. 5 is a view similar to that of FIG. 1 showing a fifth embodiment of the dispensing head.

In the embodiment of FIG. 5, the dispensing head 10 is constructed very similar to the dispensing head shown in FIG. 1. In the embodiment of FIG. 5, the seat 22 is formed of a non-porous material and is an integral part of the body dispensing head 10, for example, by moulding. The body of the dispensing head 10 is preferably formed of polypropylene.

The embodiment of FIG. 5 includes a valve member 20 formed of flexible, elastically-deformable porous material, so that it allows air to be taken in. For example, the valve member 20 is formed of an open-cell foam based on polyurethane, an ethylene-vinyl acetate copolymer frit, or a very-low-density polyethylene frit. The member 20 is mounted onto the lip 18 either by bonding or by welding, and the member 20 partially defines a dispensing opening 19.

Part of the valve member 20 is in direct contact with air outside the dispensing head. When the member 20 returns to its closed position on the seat 22, air is taken in not via the seat 22, but through the member 20 itself. This air then passes into the container 1 under the effect of the partial vacuum therein. Because the member 20 contacts the seat 22, air preferably passes through the member 20 before travelling into the opening 19, rather than passing directly into the opening 19. With structure of this embodiment, the valve member 20 functions to open and close the opening 19, and also has to take in air.

When a lid 25 is in the closed position shown in FIG. 5, an edge 50 on the lid 25 contacts a free end of the valve member 20, so as to keep it pressed firmly against the seat 22. This improves the seal of the valve member when the lid 25 is closed.

It will be apparent to those skilled in the art that various modifications and variations can be made to the structure and methodology of the present invention without departing from the scope or spirit of the invention. In view of the foregoing, it is intended that the present invention cover modifications and variations of this invention provided they fall within the scope of the following claims and their equivalents.

What is claimed is:

1. A dispensing head for a container containing a product, the dispensing head comprising:

a portion defining at least one opening on the dispensing head for permitting dispensing of the product via the opening;

a valve configured to limit direct flow of air into the container via the opening and to permit dispensing of the product via the opening, the valve including at least one member movable between a first position limiting direct flow of air into the container via the opening and a second position permitting dispensing of the product via the opening wherein the member is elastically deformable and is formed of porous material, the porous material being impervious to the product and being capable of allowing passage of air into the container via the porous material.

2. The dispensing head of claim 1, wherein the porous material is configured so that air is capable of passing into the container via the porous material when the member is in the first position.

3. The dispensing head of claim 1, wherein the member is movable from the first position to the second position in response to pressure of the product, the member being capable of elastically moving from the second position to the first position.

4. The dispensing head of claim 1, wherein the member is configured to cover the opening when the member is in the first position.

5. The dispensing head of claim 1, wherein the porous material is chosen from at least one of semi-crystalline thermoplastic frit, ethylene-vinyl acetate copolymer, very low density polyethylene, and open-cell polyurethane foam.

6. The dispensing head of claim 1, wherein the member includes a non-porous elastically deformable material chosen from natural elastomer, synthetic elastomer, thermoplastic elastomer, copolymers of polypropylene, copolymers of SEBS, styrene-butadiene copolymer, ethylene-vinyl acetate copolymer, very low density polyethylene, nitrile rubber, polychloroprene, neoprene, ethylenepropylene-diene monomer terpolymer (EPDM), butadiene-acrylonitrile copolymer, polyurethane, plasticized polyvinyl chloride, cross-linked rubber, and silicone rubber.

7. The dispensing head of claim 1, wherein the valve further includes a seat, the member contacting the seat when the member is in the first position and being spaced from the seat when the member is in the second position.

8. The dispensing head of claim 7, wherein the opening on the dispensing head and the member have an annular shape and encircle the seat, and wherein the member has a free end contacting the seat when the member is in the first position.

9. The dispensing head of claim 7, wherein the seat has an annular shape and defines the opening, and wherein the member is configured to move from the first position to the second position in response to pressure of the product.

10. The dispensing head of claim 7, wherein the seat is formed of a rigid or semi-rigid material chosen from polyolefin, polypropylene, high density polyethylene, low density polyethylene, and polyvinyl chloride.

11. The dispensing head of claim 7, wherein the seat is formed of a porous material chosen from polyolefin, high density polyethylene frit, low-density polyethylene frit, very low density polyethylene frit, polypropylene frit, polyethylene frit, polypropylene frit, ethylene-vinyl acetate copolymer frit, and polyurethane foam.

12. The dispensing head of claim 1, wherein the porous member includes at least one of pores and cells, and wherein the at least one of pores and cells are separate from the opening.

13. The dispensing head of claim 1, wherein the porous material has a porosity of from about 1 $\mu$m to about 500 $\mu$m.

14. The dispensing head of claim 13, wherein the porous material has a porosity of from about 10 $\mu$m to about 200 $\mu$m.

15. The dispensing head of claim 1, further comprising a removable cap for covering the opening.

16. The dispensing head of claim 1, wherein the porous material includes an anti-microbial substance.

17. The dispensing head of claim 1, wherein the dispensing head is configured as a push button capable of being mounted on a hollow stem of a manually operated pump to permit actuation of the pump.

18. A dispenser comprising:

the dispensing head of claim 1; and a container containing the product, the dispensing head being on the container.

19. The dispenser of claim 18, wherein the container includes at least one deformable wall, the product being pressurized by applying pressure to the deformable wall.

20. The dispenser of claim 18, wherein the product has a viscous consistency.

21. The dispenser of claim 18, wherein the product is chosen from a cosmetic product and a pharmaceutical product.

22. The dispenser of claim 21, wherein the product is chosen from a cream, a gel, a milk, and a paste.

23. The dispenser of claim 18, wherein the dispensing head includes a first coupling element and the container includes a second coupling element, the first and second coupling elements being configured to removably couple together to removably couple the dispensing head on the container.

24. The dispensing head of claim 1, wherein the porous material is at least partially exposed on an exterior surface of the dispensing head.

25. A dispensing head for a container containing a product, the dispensing head comprising:

a portion defining at least one opening on the dispensing head for permitting dispensing of the product via the opening; and a valve configured to limit direct flow of air into the container via the opening and to permit dispensing of the product via the opening, the valve including at least one member movable between a first position limiting direct flow of air into the container via the opening and a second position permitting dispensing of the product via the opening, and a seat, the member contacting the seat when the member is in the first position and being spaced from the seat when the member is in the second position, wherein at least one of the seat and the member is formed of porous material, the porous material being impervious to the product and being capable of allowing passage of air into the container via the porous material.

26. The dispensing head of claim 25, wherein the porous material is at least partially exposed on an exterior surface of the dispensing head.

27. A dispensing head for a container containing a product, the dispensing head comprising:

a portion defining at least one opening on the dispensing head for permitting dispensing of the product via the opening; and a valve configured to limit direct flow of air into the container via the opening and to permit dispensing of the product via the opening, the valve including at least one member movable between a first position limiting direct flow of air into the container via the opening and a second position permitting dispensing of the product via the opening, and a seat, the member contacting the seat when the member is in the first position and being spaced from the seat when the member is in the second position, wherein one of the seat and the member is formed of porous material and the other of the seat and the member is formed of a non-porous material, the porous material being impervious to the product and being capable of allowing passage of air into the container via the porous material, and wherein the dispensing head is configured as a dispensing adaptor capable of permitting localized application of the product.

28. The dispensing head of claim 27, further comprising a molded body formed of the non-porous material, the body being configured to be mounted on the container.

29. The dispensing head of claim 27, wherein the porous material is at least partially exposed on an exterior surface of the dispensing head.

30. A dispensing head for a container containing a product, comprising:

porous material at least partially defining at least one opening on the dispensing head for permitting dispensing of the product via the opening, the porous material being impervious to the product and being capable of allowing passage of air into the container via the porous material; and a valve configured to limit direct flow of air into the container via the opening and to permit dispensing of the product via the opening.

31. The dispensing head of claim 30, wherein the valve includes at least one member movable between a first position limiting direct flow of air into the container via the opening and a second position permitting dispensing of the product via the opening.

32. The dispensing head of claim 31, wherein the porous material is configured so that air is capable of passing into the container via the porous material when the at least one member is in the first position.

33. The dispensing head of claim 31, wherein the member is formed of an elastic material, the member being movable from the first position to the second position in response to pressure of the product, and the member being capable of elastically moving from the second position to the first position.

34. The dispensing head of claim 31, wherein the member is configured to cover the opening when the member is in the first position.

35. The dispensing head of claim 31, wherein the valve further includes a seat, the at least one member contacting the seat when the at least one member is in the first position and being spaced from the seat when the at least one member is in the second position.

36. The dispensing head of claim 35, wherein at least one of the seat and the member is formed of the porous material.

37. The dispensing head of claim 35, wherein the opening on the dispensing head and the member have an annular shape and encircle the seat, and wherein the member has a free end contacting the seat when the member is in the first position.

38. The dispensing head of claim 35, wherein the seat has an annular shape and defines the opening, and wherein the member is configured to move from the first position to the second position in response to pressure of the product.

39. The dispensing head of claim 35, wherein the dispensing head is configured as a dispensing adaptor capable of permitting localized application of the product, and wherein one of the seat and the member is formed of the porous material and the other of the seat and the member is formed of a non-porous material.

40. The dispensing head of claim 39, further comprising a molded body formed of the non-porous material, the body being configured to be mounted on the container.

41. The dispensing head of claim 30, wherein the porous member includes at least one of pores and cells, and wherein the at least one of pores and cells are separate from the opening.

42. The dispensing head of claim 30, further comprising a removable cap for covering the opening.

43. The dispensing head of claim 30, wherein the porous material includes an anti-microbial substance.

44. The dispensing head of claim 30, wherein the dispensing head is configured as a push button capable of being mounted on a hollow stem of a manually operated pump to permit actuation of the pump.

45. A dispenser comprising:

the dispensing head of claim 30; and a container containing the product, the dispensing head being on the container.

46. The dispenser of claim 45, wherein the container includes at least one deformable wall, the product being pressurized by applying pressure to the deformable wall.

47. The dispenser of claim 45, wherein the product has a viscous consistency.

48. The dispenser of claim 45, wherein the product is chosen from a cosmetic product and a pharmaceutical product.

49. The dispenser of claim 45, wherein the dispensing head includes a first coupling element and the container includes a second coupling element, the first and second coupling elements being configured to removably couple together to removably couple the dispensing head on the container.

50. A dispensing head for a container, comprising:

a portion defining at least one opening on the dispensing head for permitting dispensing of the product via the opening; and a valve including a seat, and at least one member movable between a first position in which the at least one member contacts the seat to limit direct flow of air into the container via the opening and a second position in which the at least one member is spaced from the seat to permit dispensing of the product via the opening, at least one of the seat and the member being formed of porous material, the porous material being impervious to the product and being capable of allowing passage of air into the container via the porous material.

51. The dispensing head of claim 50, wherein the porous material is configured so that air is capable of passing into the container via the porous material when the member is in the first position.

52. The dispensing head of claim 50, wherein the member is formed of an elastic material, the member being movable from the first position to the second position in response to pressure of the product, and the member being capable of elastically moving from the second position to the first position.

53. The dispensing head of claim 50, wherein the member is configured to cover the opening when the member is in the first position.

54. The dispensing head of claim 50, wherein the opening on the dispensing head and the member have an annular shape and encircle the seat, and wherein the member has a free end contacting the seat when the member is in the first position.

55. The dispensing head of claim 50, wherein the seat has an annular shape and defines the opening, and wherein the member is configured to move from the first position to the second position in response to pressure of the product.

56. The dispensing head of claim 50, wherein the dispensing head is configured as a dispensing adaptor capable of permitting localized application of the product, and wherein one of the seat and the member is formed of the porous material and the other of the seat and the member is formed of a non-porous material.

57. The dispensing head of claim 56, further comprising a molded body formed of the non-porous material, the body being configured to be mounted on the container.

58. The dispensing head of claim 50, wherein the porous member includes at least one of pores and cells, and wherein the at least one of pores and cells are separate from the opening.

59. The dispensing head of claim 50, further comprising a removable cap for covering the opening.

60. The dispensing head of claim 50, wherein the porous material includes an anti-microbial substance.

61. The dispensing head of claim 50, wherein the dispensing head is configured as a push button capable of being mounted on a hollow stem of a manually operated pump to permit actuation of the pump.

62. A dispenser comprising:

the dispensing head of claim 50; and a container containing the product, the dispensing head being on the container.

63. The dispenser of claim 62, wherein the container includes at least one deformable wall, the product being pressurized by applying pressure to the deformable wall.

64. The dispenser of claim 62, wherein the product has a viscous consistency.

65. The dispenser of claim 62, wherein the product is chosen from a cosmetic product and a pharmaceutical product.

66. The dispenser of claim 62, wherein the dispensing head includes a first coupling element and the container includes a second coupling element, the first and second coupling elements being configured to removably couple together to removably couple the dispensing head on the container.

67. A dispensing head for a container containing a product, the dispensing head comprising:

a portion defining at least one opening on the dispensing head for permitting dispensing of the product via the opening;

a valve configured to limit direct flow of air into the container via the opening and to permit dispensing of the product via the opening; and porous material at least partially defining the at least one opening on the dispensing head, the porous material being impervious to the product and being capable of allowing passage of air into the container via the porous material.

68. The dispensing head of claim 67, wherein the porous material is at least partially exposed on an exterior surface of the dispensing head.

* * * * *